US007634820B2

(12) United States Patent
Rogers et al.

(10) Patent No.: US 7,634,820 B2
(45) Date of Patent: Dec. 22, 2009

(54) ADJUSTMENT MECHANISM FOR A HELMET

(75) Inventors: David Rogers, Boston, MA (US); Charles H. Rogers, Halifax, MA (US); Peter Stokes, Boston, MA (US)

(73) Assignee: Sport Maska Inc., Quebec (CA)

( * ) Notice: Subject to any disclaimer, the term of this patent is extended or adjusted under 35 U.S.C. 154(b) by 645 days.

(21) Appl. No.: 11/335,934

(22) Filed: Jan. 20, 2006

(65) Prior Publication Data

US 2007/0169251 A1 Jul. 26, 2007

(51) Int. Cl.
*A42B 1/22* (2006.01)

(52) U.S. Cl. ..... 2/417; 2/410; 2/425

(58) Field of Classification Search ..... 2/410, 2/411, 425, 417
See application file for complete search history.

(56) References Cited

U.S. PATENT DOCUMENTS

| | | | |
|---|---|---|---|
| 3,665,514 | A | 5/1972 | Durand |
| 3,882,547 | A | 5/1975 | Morgan |
| 4,404,690 | A | 9/1983 | Farquharson |
| 4,477,929 | A | 10/1984 | Mattson |
| 4,539,715 | A | 9/1985 | Clement |
| 5,956,776 | A | 9/1999 | Chartrand |
| 6,108,824 | A | 8/2000 | Fournier et al. |
| 6,154,889 | A | 12/2000 | Moore, III et al. |
| 6,159,324 | A | 12/2000 | Watters et al. |
| 6,317,896 | B1 | 11/2001 | Timms et al. |
| 6,324,700 | B1 | 12/2001 | McDougall |
| 6,341,382 | B1 | 1/2002 | Ryvin et al. |
| 6,349,416 | B1 | 2/2002 | Lampe et al. |
| 6,385,780 | B1 | 5/2002 | Racine |
| 6,418,564 | B1 | 7/2002 | Sheridan |
| 6,425,142 | B2 | 7/2002 | Sasaki et al. |
| 6,647,556 | B2 | 11/2003 | Grepper et al. |
| 6,751,808 | B2 | 6/2004 | Puchalski |
| 6,760,927 | B2 | 7/2004 | Guay |
| 6,865,752 | B2 | 3/2005 | Udelhofen et al. |
| 6,952,839 | B2 | 10/2005 | Long |
| 6,966,075 | B2 | 11/2005 | Racine |
| 6,968,575 | B2 | 11/2005 | Durocher |

(Continued)

FOREIGN PATENT DOCUMENTS

| | | |
|---|---|---|
| CA | 2191693 | 11/2006 |

(Continued)

*Primary Examiner*—Shaun R Hurley
*Assistant Examiner*—Andrew W Sutton
(74) *Attorney, Agent, or Firm*—Seyfarth Shaw LLP

(57) ABSTRACT

An adjustment mechanism for a helmet. A first sliding surface is defined in a first portion of the helmet and includes an opening. A second sliding surface is defined in a second portion of the helmet. Two spaced apart arms extend from the second sliding surface. The first and second sliding surfaces are in sliding engagement with one another with the arms sliding within the opening. A lever is pivotally connected to the first portion in proximity of the opening and pivotable between a locked position and an unlocked position. The lever has a series of regularly spaced apart parallel teeth which in the locked position protrude through the opening with at least a selected one of the teeth being engageable between the two spaced apart arms to prevent the first and second sliding surfaces from sliding relative to one another.

12 Claims, 5 Drawing Sheets

U.S. PATENT DOCUMENTS

| | | | | |
|---|---|---|---|---|
| 6,981,284 | B2 | 1/2006 | Durocher | |
| 6,996,856 | B2 | 2/2006 | Puchalski | |
| 7,000,262 | B2 | 2/2006 | Bielefeld | |
| 7,076,811 | B2 | 7/2006 | Puchalski | |
| 2002/0189056 | A1 * | 12/2002 | Gallina et al. | 24/68 R |
| 2004/0172739 | A1 * | 9/2004 | Racine | 2/417 |
| 2005/0262619 | A1 | 12/2005 | Musal et al. | |

FOREIGN PATENT DOCUMENTS

| | | |
|---|---|---|
| WO | WO 03/026452 | 4/2003 |

* cited by examiner

ADJUSTMENT MECHANISM FOR A HELMET

BACKGROUND OF THE INVENTION

1. Field of the Invention

The present invention relates in general to helmets and, more particularly, to a mechanism for adjusting the size of a helmet.

2. Background Art

Adjustable helmets have been know in the art for years, and used in different applications such as sports, firefighting, construction work, and the military. In particular, many of these adjustable helmets allow the wearer to adjust the helmet size to fit a particular head. For example, helmet adjustment mechanisms have consisted of a stud and notch or a headband with a rack and pinion adjusting mechanism.

Although these and other conventional adjustment mechanisms have worked well, they have failed in a number of areas. For instance, many prior art designs do not allow the helmet wearer to adjust the size of the helmet while wearing the helmet. Accordingly, the helmet wearer must remove the helmet, adjust the helmet, and retry the helmet size multiple times before a proper fit can be established.

Additionally, in many prior art devices, adjustment occurs merely with respect to a headband lodged and secured inside of a helmet, not with respect to the size of the helmet shell itself. Consequently, a specific helmet size, though fitting a wearer because of a headband adjustment, is not appropriate for the wearer.

Moreover many prior art adjustment mechanisms present a risk of being accidentally actuated which can leave the wearer susceptible to injury.

SUMMARY OF INVENTION

It is therefore an aim of the present invention to provide an improved helmet adjustment mechanism.

Therefore, in accordance with the present invention, there is provided an adjustment mechanism for a helmet, the mechanism comprising a first sliding surface defined in a first portion of the helmet, the first sliding surface including an opening (i.e. an elongated opening) defined through the first portion, a second sliding surface defined in a second portion of the helmet, the second sliding surface having two spaced apart arms extending therefrom, the first and second sliding surfaces being in sliding engagement with one another with the arms protruding through the opening and slidable therewithin, and a lever pivotally connected to the first portion in proximity to the opening and pivotable between a locked position and an unlocked position, the lever having a series of regularly spaced apart parallel teeth which in the locked position protrude through the opening with at least a selected one of the teeth being engageable between the two spaced apart arms to prevent the first and second sliding surfaces from sliding relative to one another, the lever in the unlocked position being pivoted away from the opening such that the teeth are disengaged from the arms.

Also in accordance with the present invention, there is provided a helmet comprising a first shell section including at least one first sliding surface with an opening (i.e. an elongated opening) defined therethrough, a second shell section connected to the first shell section to form a helmet shell, the first and second shell sections being connected to allow a relative sliding motion therebetween, the second shell section having one corresponding second sliding surface for each first sliding surface, the second sliding surface being in sliding engagement with the first sliding surface and having at least two spaced apart arms extending therefrom and protruding through the opening such that the relative sliding motion causes the arms to slide within the opening, and a lever for each first sliding surface, the lever having at least two teeth protruding therefrom, the lever being pivotally connected to the first shell section in proximity to the opening to be pivotable between a locked position and an unlocked position, the lever in the locked position having the teeth protruding through the opening with a selected one of the teeth being engageable between the two spaced apart arms to block the relative sliding motion, the lever in the unlocked position having the teeth disengaged from the arms to allow the relative sliding motion.

BRIEF DESCRIPTION OF THE DRAWINGS

Reference will now be made to the accompanying drawings, showing by way of illustration a particular embodiment of the present invention and in which.

DESCRIPTION OF THE PARTICULAR EMBODIMENTS

Figure 1:
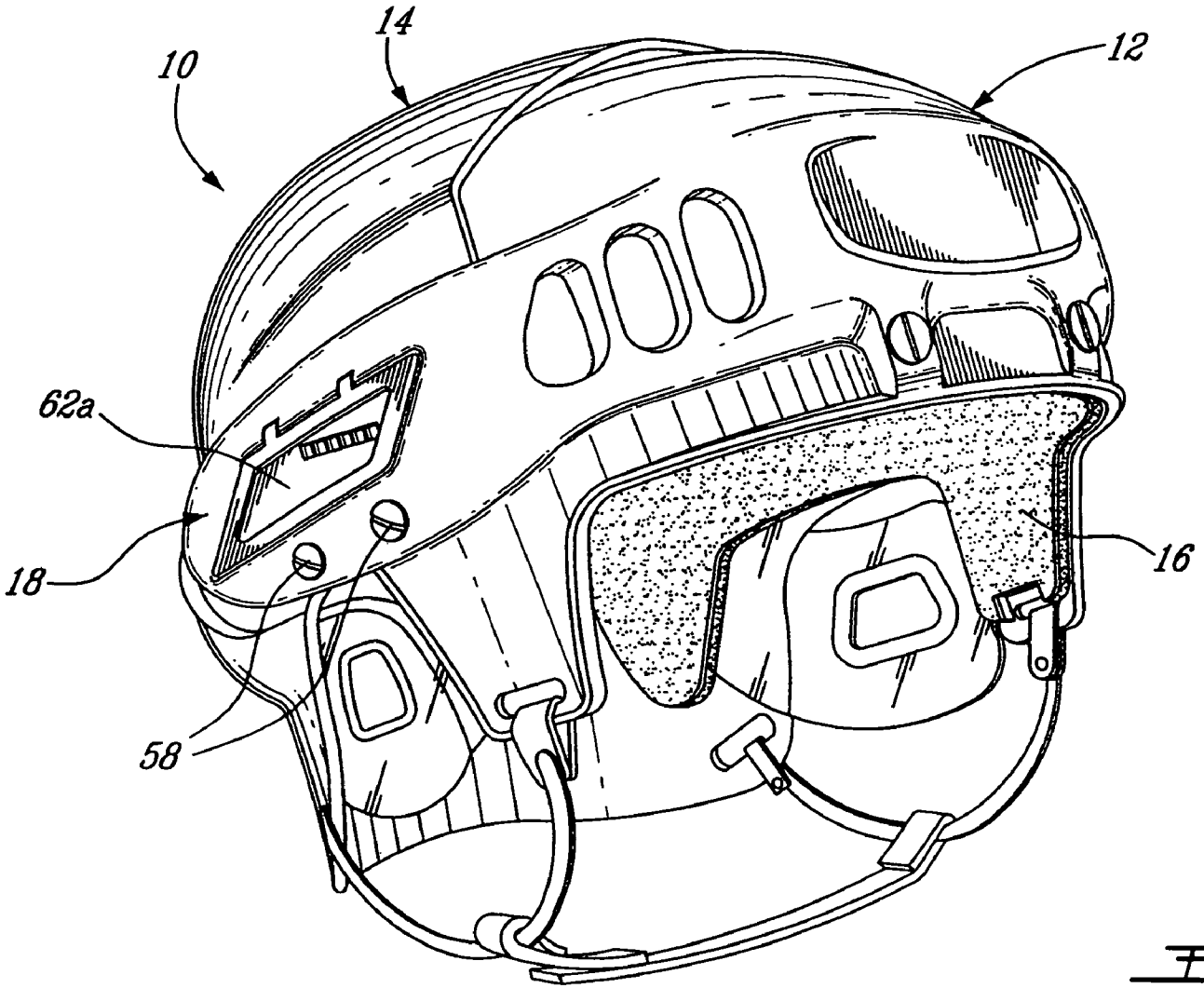
FIG. 1 is a perspective view of a helmet having an adjustment mechanism according to a particular embodiment of the present invention.

Referring to FIG. 1, a helmet such as a hockey helmet generally shown at 10 comprises a front section 12 and a rear section 14 cooperating to form a helmet shell. The front and rear sections 12,14 are preferably formed of a high strength plastic material, composite material or a combination of two or more materials having an impact absorbing liner 16 disposed therein. The front and rear sections 12, 14 are interconnected through a pair of locking assemblies generally indicated at 18, only one of which being shown in FIG. 1. The locking assemblies 18 are part of the adjustment mechanisms according to a particular embodiment of the present invention.

Figure 2:
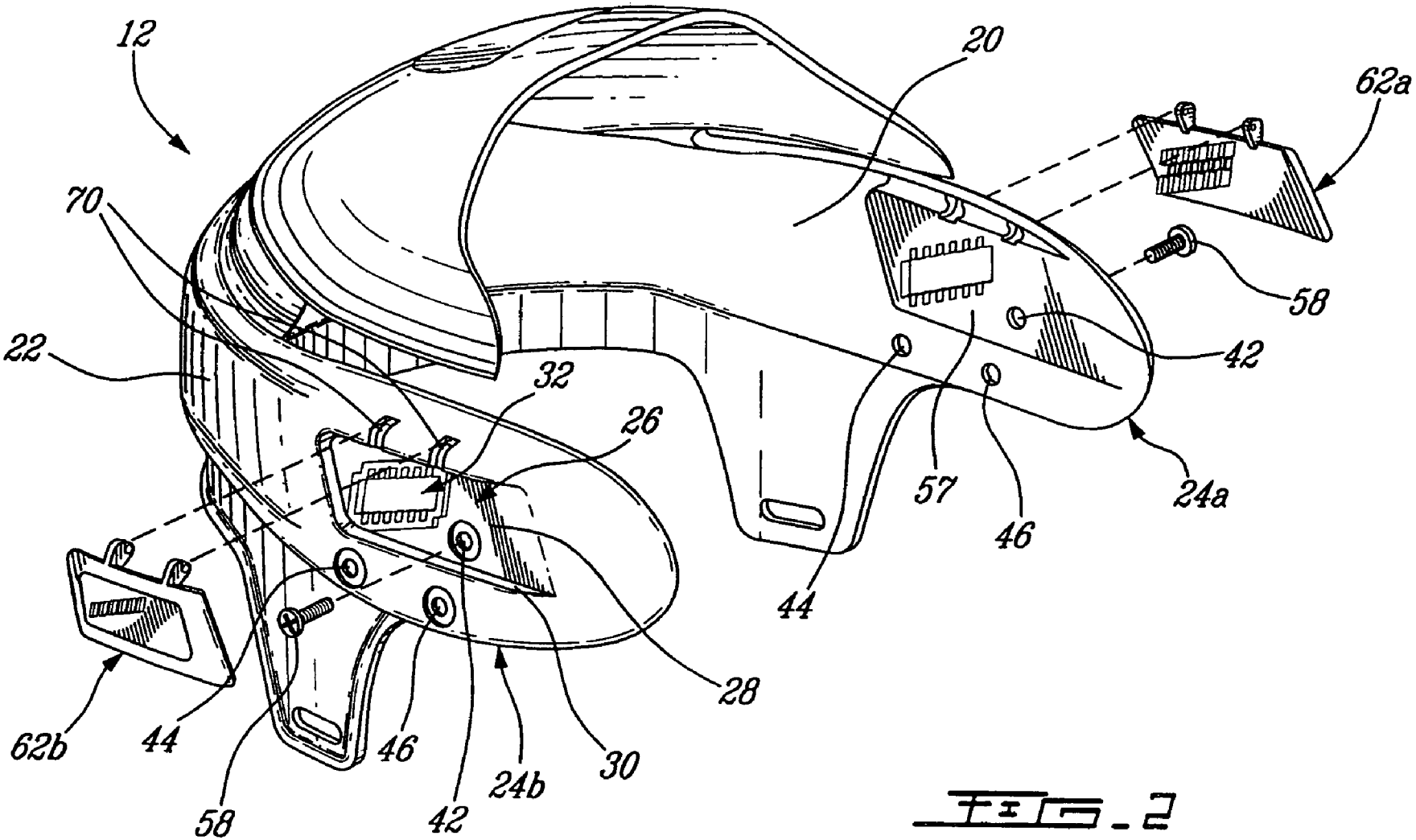
FIG. 2 is a perspective exploded view of a front section and of levers of the helmet of FIG. 1.

Referring to FIG. 2, the front section 12 has an inner surface 20 facing the head of a user and an opposed outer surface 22. The front section 12 also has two opposed side portions 24*a,b*, each including an elongated recess 26 defined in the outer surface 22. Although the recess 26 is shown here as having a parallelogram shape, it is understood that various other shapes are also possible, for example oblong, rectangular, triangular, etc. The recess 26 is defined by a recessed wall 28 substantially parallel to and inwardly offset from the outer surface 22, and connected thereto along its perimeter by a recessed border 30.

Figure 3:
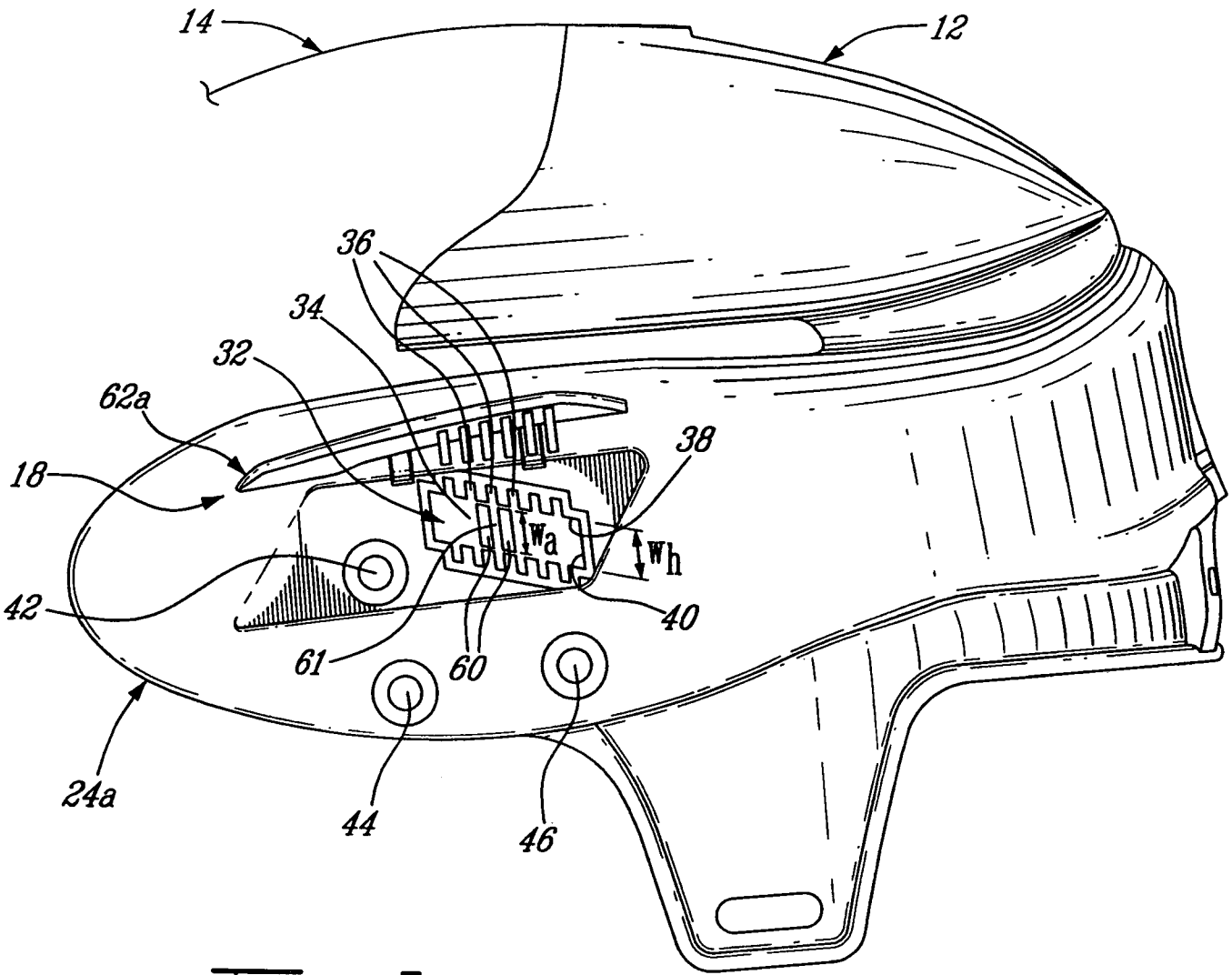
FIG. 3 is a side, partial view of the helmet of FIG. 1, showing one of the levers in an unlocked position.

The recessed wall 28 includes an elongated opening 32 defined therethrough configured and designed to be in communication with the inner surface 20. Referring to FIG. 3, the opening 32 is formed by an elongated hole 34 from which extends a series of regularly spaced apart slots 36. The elongated hole 34 has a parallelogram shape defined by two parallel elongated sides 38 and two parallel short sides 40, the short sides 40 defining a width $W_h$ of the elongated hole 34.

The spaced apart slots 36 extend substantially parallel to the short sides 40, with each slot 36 extending from one of the elongated sides 38 in alignment with a corresponding slot 36 extending from the other elongated side 38.

Referring to FIGS. 2 and 3, the front section 12 also has first, second and third holes 42,44,46 defined in each of the side portions 24*a,b*. Each first hole 42 is defined through its respective recessed wall 28, while the second and third holes 44,46 are defined through the wall of the side portion 24*a,b* under the respective recess 26.

Figure 4:
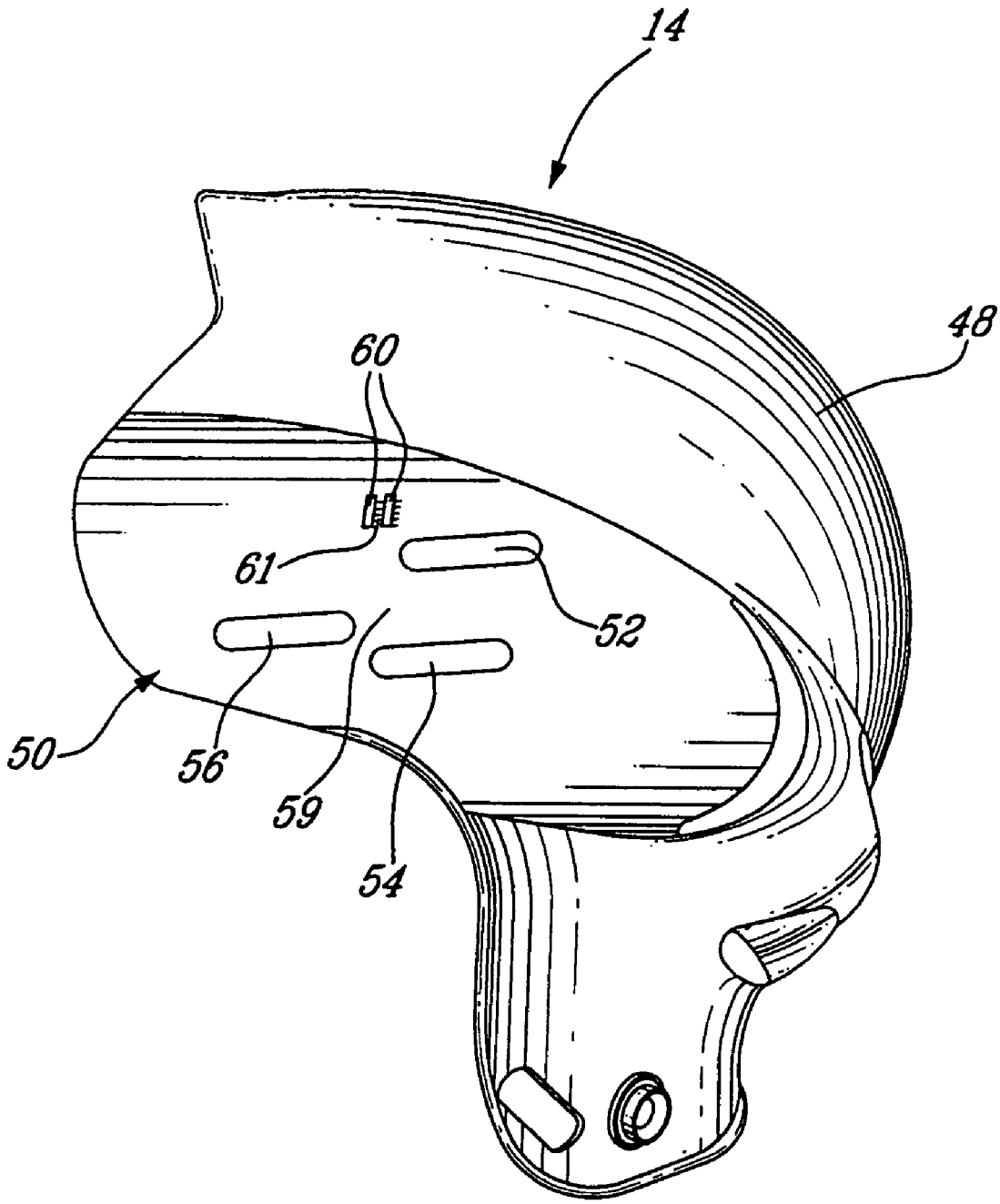
FIG. 4 is a side view of a rear section of the helmet of FIG. 1.

Referring to FIG. 4, the rear section 14 has an inner surface (not shown), an outer surface 48, and two side portions 50 (only one of which is shown). Each side portion 50 has first, second and third slots 52,54,56 defined therethrough. The slots 52,54,56 are substantially parallel to each other and spaced apart in a pattern corresponding to a pattern formed by the first, second and third holes 42,44,46 of the front section 12, such that each slot 52,54,56 is aligned with a corresponding one of the holes 42,44,46 when the front and rear sections 12,14 are engaged to form the helmet 10.

In the embodiment shown, the slots 52,54,56 have an oblong shape, although alternate shapes such as rectangular, polygonal, etc. are also possible. Of course, the holes 42,44, 46 and slots 52,54,56 can be in a number of alternative locations and configurations, including having the slots 52,54,56 defined in the front section 12 and the holes 42,44,46 defined in the rear section 14 and/or having more or less holes 42,44, 46 and slots 52,54,56.

A plurality of screws 58 (see FIGS. 1 and 2) interconnect the front and rear sections 12,14, one screw 58 being inserted through each pair of corresponding hole and slot 42,52; 44,54; 46,56. The interconnected front and rear sections 12,14 are thus slidable with respect to one another through sliding of the screws 58 within the respective slot 52,54,56. The contact between the front and rear sections 12,14 is done through sliding surfaces 57,59 which are in sliding engagement with one another in a substantially interference-free manner. The sliding surfaces 57 of the front section 12 are defined by the inner surface 20 thereof within the side portions 24*a,b* (see FIG. 2). The sliding surfaces 59 of the rear section 14 are defined by the outer surface 48 thereof within the side portions 50 (see FIG. 4). Also, as the top portion of the rear section 14 overlaps the top portion of the front section 12 when the two are engaged to one another, the outer surface 22 of the front section 12 at that location slides against the inner surface (not shown) of the rear section 14, again without substantial interference.

The helmet front and rear sections 12,14 may be releasably secured together in a desired adjusted position by the locking assemblies 18. As part of the locking assemblies 18, each side portion 50 of the rear section 14 includes two spaced apart arms 60 (see FIGS. 3-4) extending from the outer surface 48. As can be seen in FIG. 3, the arms 60 have a width $W_a$ which is smaller than the width $W_h$ of the elongated hole 34 of the front section 12, and are located such as to extend therethrough when the front and rear sections 12,14 are slidably engaged. Thus, the arms 60 are slidable within the elongated hole 34 following the relative sliding motion of the front and rear sections 12,14. The arms 60 define a free space 61 therebetween which has substantially the same size than and can be substantially aligned with corresponding slots 36 of the opening 32.

Figure 5:
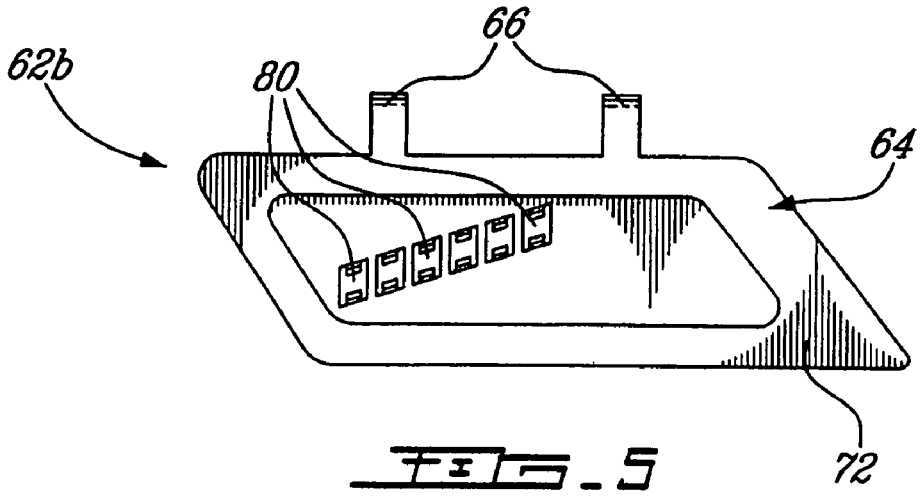
FIG. 5 is a front view of the lever of FIG. 3.
Figure 6:
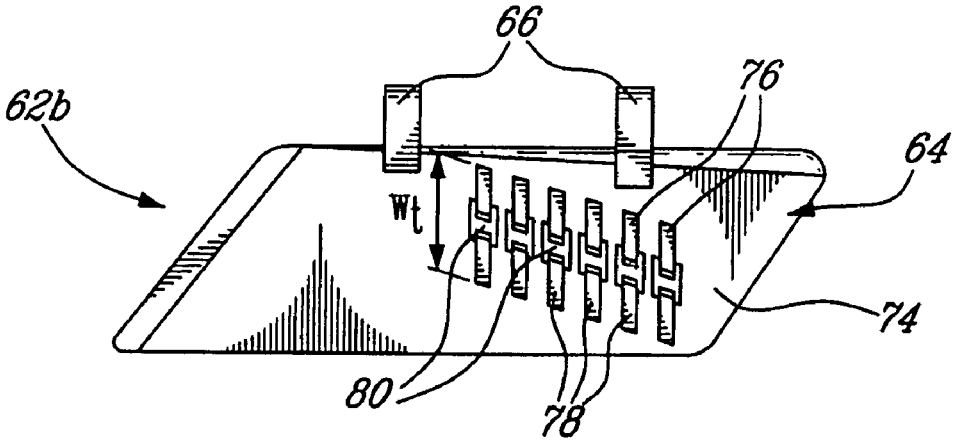
FIG. 6 is a rear view of the lever of FIG. 3.
Figure 7:
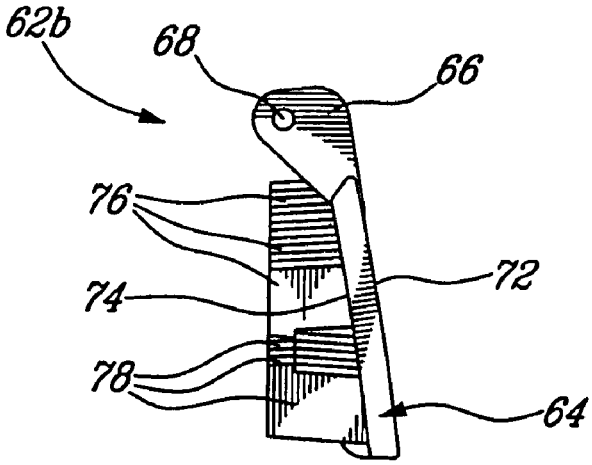
FIG. 7 is a side view of the lever of FIG. 3.

Each locking assembly 18 also includes a lever 62*a,b*. Referring to FIGS. 5 to 7, only the left-side lever 62*b* will be described in further detail, the right-side lever 62*a* being a mirror image of the left-side lever 62*b*. The lever 62*b* includes a body 64 shown here as having a parallelogram shape, although other shapes are also possible. In the embodiment shown, the body 64 is shaped such as to be receivable within the corresponding recess 26, as will be further detailed below.

Two attachment arms 66 extend from the body 64, each arm 66 having a hole 68 defined therethrough (see FIG. 7) with the two holes 68 being aligned with one another. The arms are receivable within corresponding indentations 70 defined in the front section 12 in proximity of the recess 26 (see FIG. 2). A pin (not shown) is insertable through the aligned holes 68 and retained on the front section 12, thus attaching the lever 62*b* to the front section 12 in a pivotable manner. Other means of pivotably attaching levers 62*a,b* to the front section are possible, including through the use of a press-fit attachment, etc. The lever 62*b* is thus pivotable between a locked position, where the body 64 can be located within the recess 26 of the front section 12 (see FIG. 1) and an unlocked position, where the body 64 can extend, for example, substantially perpendicular to the adjacent portion of the outer surface 22 of the front section 12 (see FIG. 3). In an alternate embodiment, the recess 26 can be omitted and the lever 62*b* in the locked position lies against the outer surface 22 of the side portion 24.

Referring to FIG. 5, the body 64 defines an outer surface 72 upon which can be included a desired indicia, for example the helmet brand or a team logo.

Referring to FIGS. 6-7, the body 64 also defines an inner surface 74 from which extend a plurality of spaced apart teeth 76,78. In the embodiment shown, the teeth 76,78 are distributed in a top row of teeth 76 and a bottom row of teeth 78, with each top tooth 76 being aligned with a corresponding bottom tooth 78. Alternately, the two rows of aligned teeth 76,78 can be replaced by a single row of larger teeth.

The teeth 76,78 are sized and positioned to be insertable in the slots 36 of the opening 32 of the front section 12 when the lever 62*a,b* is in the locked position, and as such are shown here as being distributed following a parallelogrammic pattern. The top and bottom teeth 76,78 thus together have a total width $W_t$ (see FIG. 6) which is greater than the width $W_h$ (see FIG. 3) of the elongated hole 34, the portion of the teeth 76,78 extending beyond the hole 34 being receivable within the slots 36. Of course, other configurations are possible, as long as the opening 32 is configured adequately to be able to receive the teeth 76,78 therein.

The body 64 is also shown as having a plurality of holes 80 defined therethrough between each pair of aligned bottom and top teeth 76,78, although such holes 80 can be alternately omitted.

Thus, in use and as described above, the helmet is formed by assembling the front and rear sections 12,14 (see FIG. 1) by inserting and securing the screws 58 (see FIGS. 1-2) into each of the first, second and third slots 52,54,56 and corresponding one of the first, second and third holes 42,44,46.

Then, the size of the helmet 10 is adjusted with the levers 62*a,b* in the unlocked position shown in FIG. 3. The front and rear sections 12,14 are thus free to slide with respect to one another, within a limit determined by the sliding motion of each screw 58 in its respective slot 52,54,56, and by the sliding motion of the arms 60 within the elongated hole 34. The front and rear sections 12,14 are moved to one of the positions where the free space 61 between the arms 60 is substantially continuous with one pair of aligned slots 36 of the opening 32. In the embodiment shown, seven (7) different positions are thus possible, i.e. one for each pair of aligned slots 36, although it is understood that more or less positions can be provided by varying the number of slots 36 or the number of arms 60.

Once the front and rear sections 12,14 are in the desired position, the levers 62*a,b* are pivoted to the locked position shown in FIG. 1, where the teeth 76,78 are engaged in the elongated hole 34 and slots 36 of the opening 32 of the front section 12, and one pair of top and bottom teeth 76,78 is additionally engaged in the space 61 between the arms 60 extending from the rear section 14. Alternately, in cases where a single row of larger teeth are provided as discussed above, a single tooth is engaged within the space 61. Thus, the engaged arms 60 and teeth 76,78 effectively block the relative sliding motion of the front and rear sections 12,14, thus locking the helmet 10 in the desired position and size. The adjustment can be accomplished while a user is wearing the helmet 10 or, if desired, while the helmet 10 is removed from the wearer's head.

In the locked position, the levers 62*a,b* can advantageously be completely contained in the respective recess 26, and in a particular embodiment, disposed below the level of the outer surface 22 of the front section 12, and as such shielded from accidental or unwanted contact.

The embodiments of the invention described above are intended to be exemplary. Those skilled in the art will therefore appreciate that the foregoing description is illustrative only, and that various alternatives and modifications can be devised without departing from the spirit of the present invention.

For example, the present device could be use in numerous other types of helmets or protection gear, and should not be viewed as limited to hockey or even to sports. For example, the present invention may be used in relation to lacrosse, football, and other contact sports. Also, the slots 36 could be omitted from the opening 32, and in this case the teeth 76,78 would be sized to fit within the elongated hole 34. More or less teeth 76,78 can be provided, as well as more than two arms 60.

Accordingly, the present invention is intended to embrace all such alternatives, modifications and variances which fall within the scope of the appended claims.

The invention claimed is:

1. An adjustment mechanism for a helmet, the mechanism comprising:

a first sliding surface defined in a first portion of the helmet, the first sliding surface including an opening defined through the first portion;

a second sliding surface defined in a second portion of the helmet, the second sliding surface having two spaced apart arms extending therefrom, the first and second sliding surfaces being in sliding engagement with one another with the arms protruding through the opening and slidable therewithin; and a lever pivotally connected to the first portion in proximity to the opening and pivotable between a locked position and an unlocked position, the lever having a series of regularly spaced apart parallel teeth which in the locked position protrude through the opening with at least a selected one of the teeth being engageable between the two spaced apart arms to prevent the first and second sliding surfaces from sliding relative to one another, the lever in the unlocked position being pivoted away from the opening such that the teeth are disengaged from the arms;

wherein the spaced apart arms are accessible through the opening.

2. The adjustment mechanism according to claim 1, wherein the first section has a recess defined therein around the opening, the lever being received in the recess in the locked position.

3. The adjustment mechanism according to claim 1, wherein the opening is formed by an elongated hole and a series of parallel, regularly spaced apart slots extending from the elongated hole, the elongated hole slidably receiving the arms therein, and wherein when the lever is in the locked position a first portion of the teeth is received in the elongated hole and a remaining portion of the teeth is received within the slots.

4. The adjustment mechanism according to claim 1, wherein the first and second sliding surfaces are in sliding engagement without substantial interference therebetween.

5. A helmet comprising:

a first shell section including at least one first sliding surface with an opening defined therethrough;

a second shell section connected to the first shell section to form a helmet shell, the first and second shell sections being connected to allow a relative sliding motion therebetween, the second shell section having one corresponding second sliding surface for each first sliding surface; the second sliding surface being in sliding engagement with the first sliding surface and having at least two spaced apart arms extending therefrom and protruding through the opening such that the relative sliding motion causes the arms to slide within the opening; and a lever for each first sliding surface, the lever having at least two teeth protruding therefrom, the lever being pivotally connected to the first shell section in proximity of the opening to be pivotable between a locked position and an unlocked position, the lever in the locked position having the teeth protruding through the opening with a selected one of the teeth being engageable between the two spaced apart arms to block the relative sliding motion, the lever in the unlocked position having the teeth disengaged from the arms to allow the relative sliding motion;

wherein the two spaced apart arms are accessible through the opening.

6. The helmet according to claim 5, wherein the first section includes two opposed first side portions with an inner surface of each first side portion defining one of the at least one first sliding surface, and the second section includes two opposed second side portions with an outer surface of each second side portion defining one of the corresponding second sliding surfaces.

7. The helmet according to claim 5, wherein an outer surface of a top portion of the first section is in contact with an inner surface of a top portion of the second section.

8. The helmet according to claim 5, wherein one of the first and second sections has a plurality of slots defined therein and the other of the first and second sections has a corresponding hole defined therein for each of the plurality of slots, the second section being connected to the first section by the insertion of a connecting member through each of the slots and corresponding hole, the connecting members being slidable within a respective one of the slots to allow the relative sliding motion.

9. The helmet according to claim 5, wherein the first section is a front section of the helmet shell and the second section is a rear section of the helmet shell.

10. The adjustment mechanism according to claim 5, wherein the first section has a recess defined therein around the opening, the lever being received in the recess in the locked position.

11. The adjustment mechanism according to claim 5, wherein the opening is formed by an elongated hole and a series of parallel, regularly spaced apart slots extending therefrom, the elongated hole slidably receiving the arms therein and having a width smaller than a total width of the teeth, and the slots being located and sized to receive a portion of the teeth extending beyond the elongated hole when the lever is in the locked position.

12. The adjustment mechanism according to claim 5, wherein the first and second sliding surfaces are in sliding engagement without substantial interference therebetween.

* * * * *

UNITED STATES PATENT AND TRADEMARK OFFICE

CERTIFICATE OF CORRECTION

PATENT NO. : 7,634,820 B2
APPLICATION NO. : 11/335934
DATED : December 22, 2009
INVENTOR(S) : David Rogers, Charles H. Rogers and Peter Stokes It is certified that error appears in the above-identified patent and that said Letters Patent is hereby corrected as shown below:

Column 5 line 62 "the spaced" should be "the two spaced".

Signed and Sealed this

Sixteenth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,634,820 B2
APPLICATION NO. : 11/335934
DATED : December 22, 2009
INVENTOR(S) : Rogers et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 981 days.

Signed and Sealed this

Ninth Day of November, 2010

David J. Kappos

David J. Kappos
*Director of the United States Patent and Trademark Office*